United States Patent [19]

Kai et al.

[11] Patent Number: 4,679,718

[45] Date of Patent: Jul. 14, 1987

[54] CUTTER FOR DISPENSING CONTAINER AND DISPENSING CONTAINER PROVIDED WITH SAID CUTTER

[75] Inventors: Hisao Kai, Chiba; Kensuke Ochiai, Tokyo; Takeshi Niisato, Saitama, all of Japan

[73] Assignee: Asahi Kasei Kogyo Kabushiki Kaisha, Osaka, Japan

[21] Appl. No.: 843,471

[22] Filed: Mar. 24, 1986

[30] Foreign Application Priority Data

Mar. 25, 1985 [JP] Japan ..... 60-58279
Mar. 25, 1985 [JP] Japan ..... 60-58280

[51] Int. Cl.[4] ..... B65D 85/672

[52] U.S. Cl. ..... 225/48; 51/401; 225/91

[58] Field of Search ..... 225/48-50, 225/91, 92; 51/401

[56] References Cited

U.S. PATENT DOCUMENTS

| | | | |
|---|---|---|---|
| 2,024,591 | 12/1935 | Manchester | 51/401 X |
| 2,888,181 | 5/1959 | Lincoln et al. | 225/91 X |
| 4,346,830 | 8/1982 | Hauser | 225/49 |
| 4,465,215 | 8/1984 | Kai | 225/48 |
| 4,606,154 | 8/1986 | Herrmann et al. | 51/401 |

*Primary Examiner*—Frank T. Yost
*Attorney, Agent, or Firm*—Armstrong, Nikaido, Marmelstein & Kubovcik

[57] ABSTRACT

A cutter has a file-like coarse surface formed on a substrate by fast adhesion of irregular granules to the surface of the substrate with a soft adhesive agent. A dispensing container has the cutter attached fast thereto. The cutter can be folded and attached fast to a ridge of a dispensing container, the ridge in a position such that a sheet material drawn out of the dispensing container will be pressed most readily, without sustaining a crack in the layer of adhesive agent and inducing unwanted separation of irregular granules from the substrate.

16 Claims, 21 Drawing Figures

(a)

(b)

(c)

CUTTER FOR DISPENSING CONTAINER AND DISPENSING CONTAINER PROVIDED WITH SAID CUTTER

BACKGROUND OF THE INVENTION

This invention relates to a cutter attached to a dispensing container for a sheet material such as synthetic resin film, aluminum foil, wax paper, or glassine and used for cutting a necessary length of the sheet material drawn out of the dispensing container and to a dispensing container provided with the cutter. More particularly, this invention relates to a cutter for cutting the sheet material by dint of a coarse surface such as of a sandpaper which has no possibility of inflicting any injury upon the user's finger and to a dispensing container provided with this cutter.

A cutter for a dispensing container which uses a coarse file-like surface as a blade for cutting the sheet material is disclosed in the specification of U.S. Pat. No. 4,465,215. This cutter is produced by forming a file-like coarse surface on one side of a substrate. In the U.S. patent specification mentioned above, there is a statement to the effect that the file-like coarse surface is obtained by applying an adhesive agent containing abrasive granules on one side of the substrate or by applying an adhesive agent on one side of the substrate and subsequently sprinkling abrasive granules on the applied adhesive layer.

The cutter using a file-like coarse surface as its cutting blade cuts a given sheet material by first inserting a slit at one end of the sheet material by the pressure exerted thereon against a fine, sharp corner of the cutting blade and causing the slit to propagate in the sheet material throughout the entire width thereof. When this cutter is to be attached to a dispensing container, the convenience of the cutter for cutting the sheet material is improved by folding the cutter and fastening the folded cutter to the dispensing container in such a manner as to cover one corner of the dispensing container in the direction in which the sheet material is drawn out of the dispensing container thereby allowing the part of the sheet material selected for cutting to be pressed and rubbed against the cutter as disclosed in the aforementioned U.S. patent specification. If the position of attachment of this cutter deviates more or less, the cutter fulfils its function effectively so long as it avoids departing completely from the apex of the corner of dispensing container. Thus, the method described above has an advantage of facilitating the work of attachment of the cutter to the dispensing container.

When a rigid adhesive agent of the type which is rigidified by being cured through a chemical reaction or desiccation is used for fast adhesion of abrasive granules to a substrate, there ensues a disadvantage that the layer of the adhesive agent sustains a crack and sheds the abrasive granules from the cracked portion when the cutter is folded. This separation of abrasive granules results in a degradation of the sharpness of the cutter. Moreover, since the sheet material held in the dispensing container is intended more often than not to wrap foodstuffs, the separation of abrasive granules can cause an impression of filthiness on the mind of the user.

There is an adhesive agent of the type which retains flexibility even after it is cured through a chemical reaction or desiccation. Any cutter which has abrasive granules attached fast to a substrate with such a flexible adhesive agent has never been proposed in the art. This situation may be logically explained by a supposition that since sandpapers of the general run invariably use the aforementioned rigid adhesive agent for ensuring fast adhesion of abrasive granules, a concept that no ample adhesion of abrasive granules is obtained by the use of a flexible adhesive agent has been generally accepted.

To preclude the unwanted separation of abrasive granules, the desirability of having part of the abrasive granules driven into the web of the substrate is disclosed in U.S. Pat. No. 4,465,215. It is, however, extremely difficult from the technical point of view to have minute abrasive granules driven into the substrate in such a manner that their upper ends are exposed from the surface of the substrate.

In the specification of U.S. Pat. No. 4,005,809, an idea of preparing a cutter by attaching abrasive granules to a strip through the medium of an adhesive agent and fastening this strip to a dispensing container is disclosed. Further in the specification of British Pat. No. 1,483,620, an idea of directly depositing abrasive granules in a narrow strip on a dispensing container with an adhesive agent and using the produced strip of abrasive granules as a cutter is disclosed.

These two patents merely teach the formation of a file-like coarse surface by a procedure which comprises applying an adhesive agent on a substrate and sprinkling abrasive granules on the formed layer of adhesive agent thereby firmly fixing the abrasive granules therein. They have absolutely no disclosure as to the kind of adhesive agent to be used for fast adhesion of abrasive granules.

SUMMARY OF THE INVENTION

The first object of this invention is to provide a cutter such that abrasive granules or other irregular granules forming a file-like coarse surface thereof will not come loose even when the cutter is folded.

The second object of this invention is to provide a dispensing container provided with the cutter which, owing to the absence of unwanted separation of irregular granules, enjoys practical utility intact and warrants convenience of use and ease of manufacture.

The first object mentioned above is accomplished by causing abrasive granules or other irregular granules selected for formation of a file-like coarse surface to adhere fast to a substrate through the medium of a soft adhesive agent instead of a hard adhesive agent generally used in sandpapers. In the case of a cutter for use on a dispensing container, since it is not strongly and continuously rubbed on a given object like an ordinary sandpaper, the use of the soft adhesive agent has no possibility of entailing unwanted separation of irregular granules. When the cutter is folded, the soft adhesive agent used therein readily stretches itself and avoids sustaining any crack. Thus, the use of the soft adhesive agent dissipates the fear that a fold formed in the cutter will inflict a crack in the adhesive agent and induce unwanted separation of irregular granules from the adhesive agent.

The second object mentioned above is accomplished by folding the aforementioned cutter lengthwise in a cross section of the shape of the letter L and fastening the folded cutter to a dispensing container in such a manner as to cover its corner at the position falling in a direction in which the sheet material is drawn out of the dispensing container. Since the cutter used herein has the irregular granules fastened in place with the aforementioned soft adhesive agent, it avoids inducing unwanted separation of irregular granules in spite of the fold formed in the cutter. Furthermore, since the cutter is disposed so as to cover the corner of the dispensing container, the sheet material drawn out of the dispensing container can be pressed and rubbed against the cutter with ease. Even if this cutter deviates slightly from its normal position, it fulfils its function effectively so long as it avoids completely coming off the apex of the corner. As a result, the attachment of this cutter to the dispensing container is easy and the manufacture of the dispensing container provided with the cutter is also easy.

The other characteristics and advantages of this invention will become apparent from the description given in further detail hereinbelow with reference to the accompanying drawings and from the comparison of working examples and comparative experiments cited below.

DETAILED DESCRIPTION OF THE INVENTION

Figure 1:
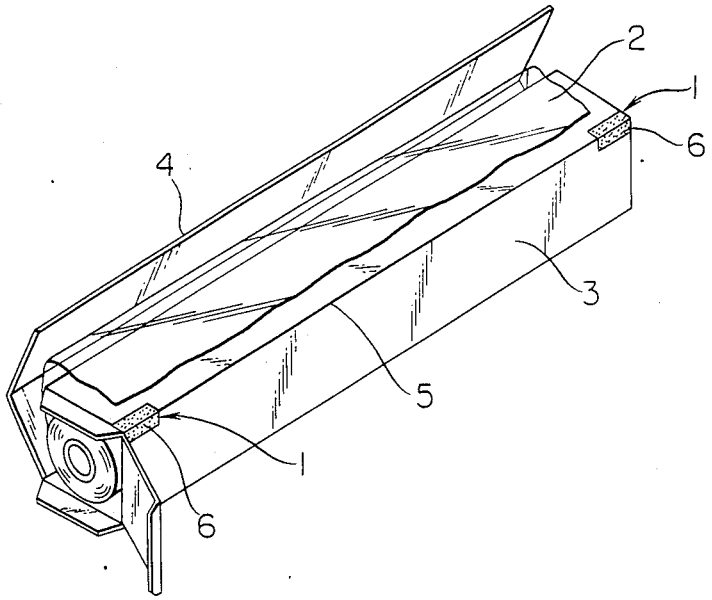
FIG. 1 is a perspective view of a typical dispensing container 3 provided with a cutter 1 contemplated by the present invention.

The cutter 1 according to this invention is intended to be used as attached to a dispensing container 3 accommodating a sheet material 2 as illustrated in FIG. 1, for example.

The dispensing container 3 is an oblong rectangular parallelepiped which can be opened lengthwise by pulling up a covering piece 4 thereof. Inside this dispensing container 3 is held a roll of the sheet material 2. When the dispensing container 3 is opened by pulling up the covering piece 4, the sheet material 2 is ready to be drawn out of the dispensing container 3. This sheet material 2 may be a synthetic resin film such as polyvinylidene chloride, polyethylene, polyvinyl chloride, or polybutadiene, a metal foil such as aluminum foil, a paper such as wax paper, parchment paper, or glassine, or a laminate thereof.

Figure 2:
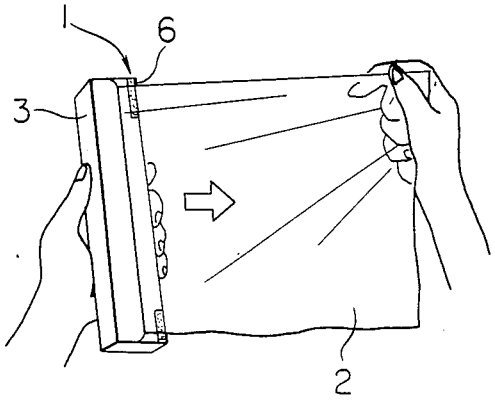
FIGS. 2(*a*)-(*c*) are an explanatory diagram illustrating a procedure adopted for cutting a sheet material 12 drawn out of the dispensing container 2 of FIG. 1.
Figure 2:
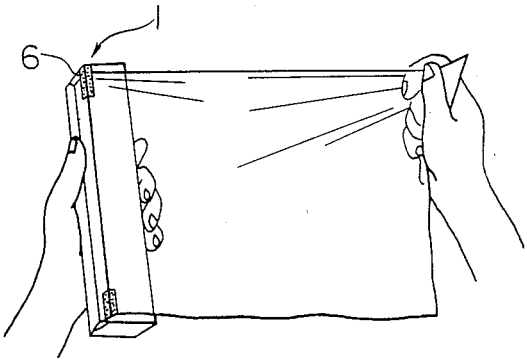
Figure 2:
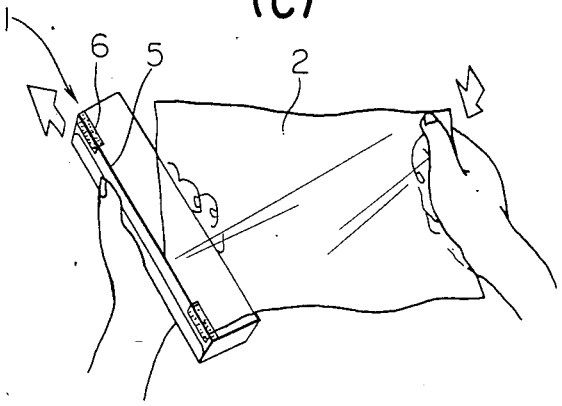

The cutters 1 folded lengthwise at an angle of about 90° are fastened, with the file-like coarse surfaces 6 thereof held on the outer side, to the dispensing container 3 in such a manner as to cover the opposite ends of a ridge 5 of the dispensing container 3 positioned in a direction in which the sheet material 2 is drawn out of the container. When the sheet material 2 is pulled out to a required length as shown in FIG. 2(*a*) and then pulled down with one lateral end part thereof pressed against the file-like coarse surface 6 of the cutter 1 as shown in FIG. 2(*b*), a slit is formed in the lateral end part of the sheet material 2. Now, the required length of the sheet material can be cut off from the sheet material by propagating the slit along a ridge 5 as shown in FIG. 2(*c*).

Figure 3:
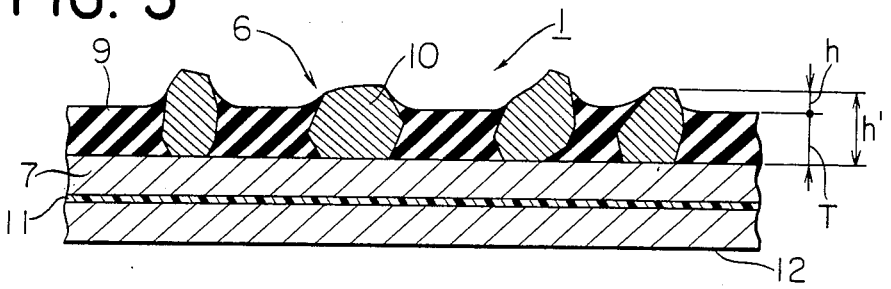
FIG. 3 is a magnified longitudinal cross section illustrating a typical cutter 1 in a state to be attached to the dispensing container 3.
Figure 4:
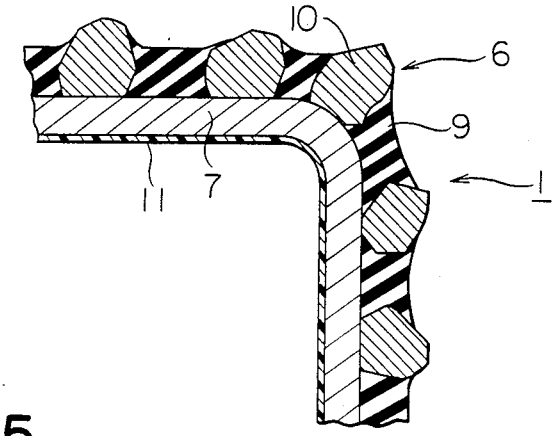
FIG. 4 is a magnified longitudinal cross section illustrating the cutter 1 of FIG. 2 in a state stripped of a release paper 12 and folded at an angle of about 90°.

The cutter 1 may be given a file-like coarse surface 6 by applying a soft adhesive agent 9 on the surface of a substrate 7 and sprinkling irregular granules 10 on the layer of adhesive agent thereby allowing the irregular granules 10 to dip into the layer of soft adhesive agent so much that the head parts of the irregular granules 10 will remain substantially bare of the soft adhesive agent 9 as shown in FIG. 3 and FIG. 4. In this case, after the soft adhesive agent 9 is applied on the surface of the substrate 7, the irregular granules 10 sprinkled onto the layer of the soft adhesive agent 9 are required to be buried to a certain depth into the layer and, at times, to be pushed down farther into the layer. Thus, the manufacture of the cutter 1 is troublesome. The cutter 1, therefore, is preferred to be made as shown in FIG. 5 and FIG. 6.

Figure 5:
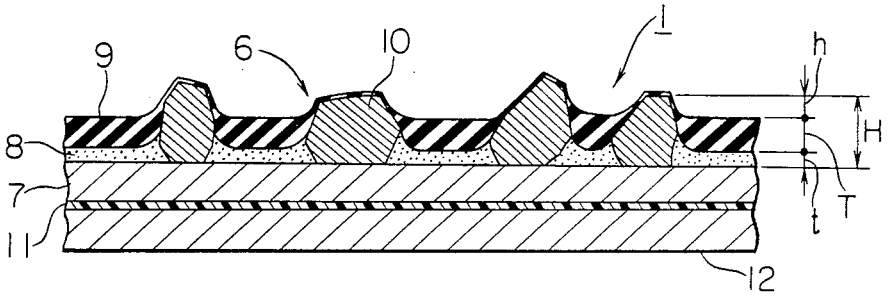
FIG. 5 is a magnified longitudinal cross section illustrating another typical cutter in a state to be attached to the dispensing container 3.
Figure 6:
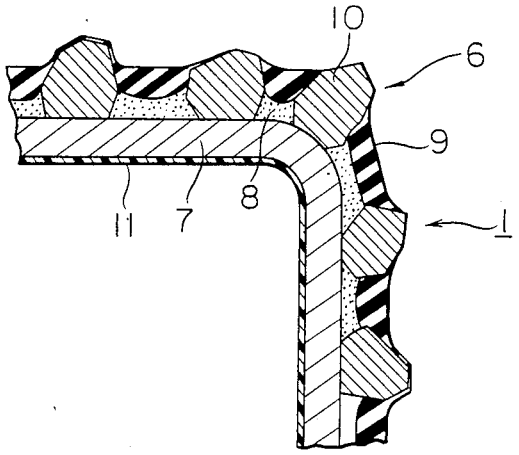
FIG. 6 is a magnified longitudinal cross section illustrating the cutter 1 of FIG. 5 in a state stripped of a release paper 12 and folded at an angle of about 90°.

The cutter 1 illustrated in FIG. 5 and FIG. 6 is given a file-like coarse surface 6 by applying an undercoating adhesive agent 8 on the surface of a substrate 7, sprinkling irregular granules 10 on the applied layer of the undercoating adhesive agent 8, allowing the layer of the undercoating adhesive agent 8 to cure by chemical reaction or desiccation, brushing loose irregular granules 10 off the cured layer of the undercoating adhesive agent, then applying a soft adhesive agent 9 on the irregular granules 10 firmly planted in the layer of the undercoating adhesive agent. In the case of this cutter 1, though the soft adhesive agent 9 is applied on the upper parts of the irregular granules 10, virtually all the soft adhesive agent 9 which has landed on the upper parts is caused to flow down by gravitational attraction and collect in the spaces intervening between adjacent irregular granules 10, leaving a very thin coating of soft adhesive agent 9 on the upper parts. This coating has a thickness such that it will be readily ruptured when it is exposed to the tension exerted during the formation of a fold in the cutter 1 or when it is pressed or rubbed by the sheet material 2. Thus, this coating has no adverse effect on the sharpness (cutting ability) of the cutter 1.

The cutter 1 illustrated in FIG. 5 and FIG. 6 is enabled to keep firm hold of the irregular granules 10 by dint of the layer of the soft adhesive agent 9 covering the irregular granules 10. Compared with the cutter 1 illustrated in FIG. 3 and FIG. 4 which calls for a work of pushing the irregular granules 10 farther into the layer of the soft adhesive agent 9, the cutter 1 on the construction under discussion has an advantage of ensuring safe prevention of unwanted separation of the irregular granules 10.

The adhesion of irregular granules 10 to the surface of the substrate 7 with the layer of soft adhesive agent 9 covering the irregular granules 10 is otherwise attained by applying a mixture of irregular granules 10 with a soft adhesive agent 9 directly on the surface of the substrate 7 without using any undercoating adhesive agent 8. Even in this case, use of the undercoating adhesive agent 8 proves advantageous because the mixture cannot be easily applied evenly on the substrate.

The cutter 1 of FIG. 3 and FIG. 4 and the cutter 1 of FIG. 5 and FIG. 6 have a common fact that a pressure-sensitive adhesive 11 is applied on the rear side of the substrate 7. The pressure-sensitive adhesive 11 is kept covered with a release paper 12. The cutter 1, therefore, is fastened to the dispensing container 3 when this pressure-sensitive adhesive 11 is stripped of the release paper 12 and pressed against the dispensing container 3. The cutter 1 has no use for the pressure-sensitive adhesive 11 when it is fastened to the dispensing container 3 with a separately prepared adhesive agent.

Suitably the substrate 7 is made of a material which is readily folded and is settled snugly at a prescribed position on the dispensing container 3. Concrete examples of the materials include paper, fabric, synthetic resin sheet, and laminates thereof. Desirably, the substrate 7 is required to permit fair penetration therein of the soft adhesive agent 9 or the undercoating adhesive agent 8 and to warrant intimate union thereof with the irregular granules 10. In the light of these requirements and from the economical point of view, paper is the optimum material for the substrate 7. When the substrate 7 is made of paper, this paper is expected to possess proper nerve enough to ensure ease of handling and proper snugness enough to warrant fast attachment of the cutter 1 to the dispensing container 3. Thus, the paper proves fit when the flexibility thereof falls in the range of 5 to 30 cm/15 mm, preferably 10 to 20 cm/15 mm, as measured by the method specified in JIS P-8143.

The undercoating adhesive agent 8 to be used in the cutter 1 illustrated in FIG. 5 and FIG. 6 may be the same as or different from the soft adhesive agent 9 which is to be superposed thereon. When the undercoating adhesive agent 8 is different from the soft adhesive agent 9, it is desired to be a hard adhesive agent which hardens after being cured by a chemical reaction or desiccation. When the hard adhesive agent is used, the adhesion of irregular granules 10 to the substrate 7 is attained with greater fastness. The hard adhesive agent to be used as the undercoating adhesive agent 8 is desired to exhibit satisfactory adhesiveness to the substrate 7 and the irregular granules 10 and, after being cured by a chemical reaction or desiccation, acquire a Vickers hardness in the range of 5 to 40 Hv as measured at 200 g/sec. Concrete examples of hard adhesive agents include hard synthetic resin type adhesive agents formed preponderantly of resol type phenol resin, epoxy resin, melamine resin, hard polyurethane, and urea resin.

The soft adhesive agent 9 retains its flexibility even after it is cured as by a chemical reaction or desiccation. With the flexibility enough to be expanded or contracted on exposure to a fold formed in the cutter 1, this soft adhesive agent 9 serves to hold the irregular granules 10 fast to the substrate 7. When a hard adhesive agent is used as the undercoating adhesive agent 8 illustrated in FIG. 5 and FIG. 6, the soft adhesive agent 9 joins intimately with the hard adhesive agent serving as the undercoating adhesive agent 8, presses it down with flexibility, and prevents the undercoating adhesive agent 8 from sustaining a crack when the cutter 1 is folded as illustrated in FIG. 6. This cutter 1, therefore, is free from the possibility that the layer of adhesive agent holding the irregular granules 10 fast to the substrate 7 will sustain a crack and induce unwanted separation of the irregular granules 10 when the cutter is folded.

Suitably, the soft adhesive agent 9 is required to exhibit satisfactory adhesiveness to the irregular granules 10, the substrate 7, and the undercoating adhesive agent 8 and, after being cured as by a chemical reaction or desiccation, produce an elongation of 130 to 700%, preferably 150 to 500%, and more preferably 180 to 400%, as measured by the method specified by ASTM D-882. If the elongation is very small, the cutter 1 is liable to sustain a crack when it is folded. Conversely, if the elongation is very large, the fastness of the adhesion of irregular granules 10 is liable to be insufficient. Concrete examples of soft adhesive agents 9 are rubber or soft synthetic resin type adhesive agents such as styrene-butadiene rubbers, nitrile-butadiene rubbers, polyvinyl chloride type rubbers, polyvinyl acetate type rubbers, natural rubbers, and soft polyurethane.

The irregular granules 10 to be adhered on the surface of the substrate 7 are desired to be minute granules rich in random corners with acute and obtuse angles and at least harder than the sheet material to be cut. Concrete examples of granules are such conventional abrasive granules as alundum and silicon carbide, granules of such metals as stainless steel, zinc, tin, iron, chromium carbide, copper, and brass, and mixtures of abrasive granules with metal granules. The metal granules can be produced by such methods as supercool pulverization and cold spraying, for example. The metal granules are desirable because they do not produce chippings when the file-like coarse surface 6 accidentally collides with a hard object.

Although the diameters of the irregular granules 10 are variable with the kind of substance forming the sheet material 2, they generally fall in the range of 30 to 500μ, preferably 50 to 300μ. If the diameters are very large, the irregular granules are liable to separate from the substrate. If they are very small, the cutter loses sharpness. For example, the diameters suitable for practical purposes are 100 to 260μ, where the sheet material 2 is a film of vinylidene chloride, 150 to 260μ where it is a wax paper, 200 to 260μ where it is grassine, and 70 to 260μ where it is aluminum foil.

The irregular granules 10 are desired to be deposited so that ½ to 9/10 of their height, H, is buried in the layer of the soft adhesive agent 9 or the combined layer of the soft adhesive agent 9 and undercoating adhesive agent 8 as illustrated in FIG. 3 and FIG. 5 and their height, h, protruded from the surface of the layer of the soft adhesive agent 9 is not less than 30μ. If the buried depth is smaller, the irregular granules 10 are liable to come loose. Conversely if the buried depth is very large and the protruded height is very small, the cutter loses its sharpness. Where the undercoating adhesive agent is a hard adhesive agent and it is used in combination with the soft adhesive agent 9, the thicknesses, T and t, of the layers of the soft adhesive agent 9 and the undercoating adhesive agent 8 are desired to be such that the ratio of T to t will fall approximately in the range of 1:1 to 20:1. If the thickness of the layer of the undercoating adhesive agent 8 is very small, the improvement in the adhesiveness expected of the undercoating adhesive agent 8 is not attained. Conversely if the thickness of the layer of the undercoating adhesive agent 8 is increased and that of the soft adhesive agent 9 is decreased proportionately, the layer of the undercoating adhesive agent 8 is liable to sustain a crack when the cutter 1 is folded.

Figure 7:
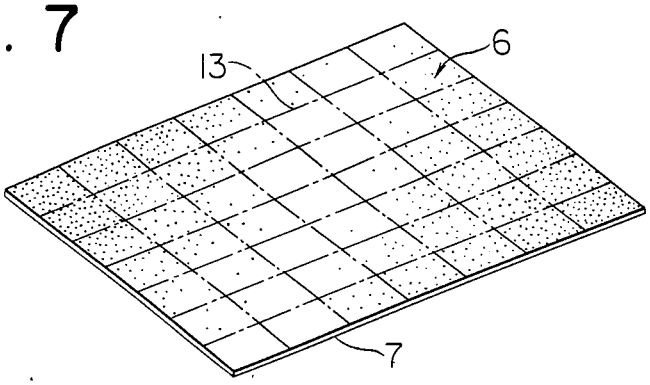
FIG. 7 is a perspective view of a typical substrate 7 of a large size on which a file-like coarse surface 6 has been formed and from which the cutter 1 is to be cut off.
Figure 8:
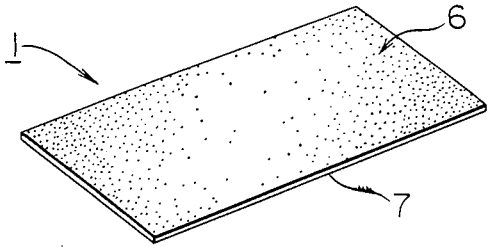
FIG. 8 is a perspective view of the cutter 1 cut out of the substrate 7 of a large size shown in FIG. 4.

The cutters 1 of the present invention can be easily mass produced by forming the file-like coarse surface 6 as described above on the entire surface of a large substrate 7 and cutting the substrate along cutting lines 13 indicated by dot and dash lines as illustrated in FIG. 7 thereby obtaining cutters 1 as illustrated in FIG. 8. In this case, since the blade of a device used in inserting cuts along the cutting lines 13 collides with the file-like coarse surface 6, it undergoes heavy abrasion when the irregular granules 10 are hard abrasive granules. This heavy abrasion of the blade can be precluded by using metal granules softer than the blade of the device for cutting the large substrate 7 as irregular granules 10.

Figure 9:
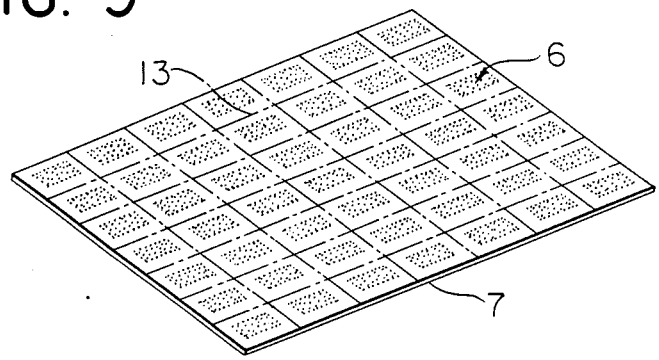
FIG. 9 is a perspective view of another typical substrate 7 of a large size on which a file-like coarse surface 6 has been formed and from the cutter 1 is to be cut off.
Figure 10:
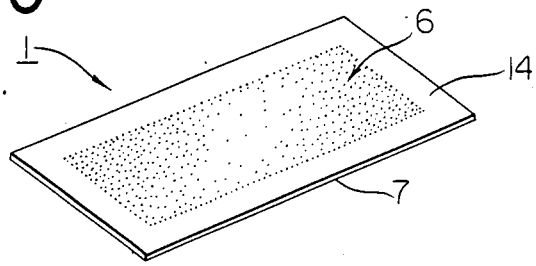
FIG. 10 is a perspective view of the cutter 1 cut from the substrate 7 of a large size shown in FIG. 6.

When the irregular granules 10 to be used are hard abrasive granules, the cutters 1 are desired to be produced by forming file-like coarse surfaces 6 of a fixed rectangular area as arrayed on the entire surface of a large substrate 7 and cutting the substrate along the cutting lines indicated by dot and dash lines drawn in the portions outside the rectangular file-like coarse surfaces 6 as illustrated in FIG. 9 and separating sections of file-like coarse surfaces enclosed with marginal parts 14 bare of irregular granules 10 as illustrated in FIG. 10. The formation of such sectioned file-like coarse surfaces 6 is easily accomplished by applying the hard adhesive agent 8 selectively on the necessary portions of the substrate 7. The soft adhesive agent 9 may be applied on the entire surface of the substrate 7 instead of being selectively applied on the portions destined to permit deposition of irregular granules 10.

Figure 11:
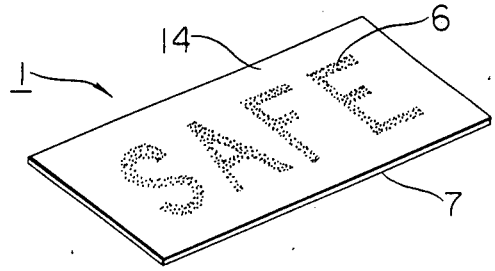
FIG. 11 is a perspective view of the cutter 1 on which a file-like coarse surface 6 has been formed in the pattern of letters.

Optionally, the cutter 1 of this invention may have the file-like coarse surface 6 formed thereon in the shape of letters or patterns as illustrated in FIG. 11. In this case, a marginal part 14 formed as illustrated serves to preclude the possibility of such letters or patterns being accidentally torn when the aforementioned sectioned coarse surfaces are cut off the large substrate 7 (FIG. 7 and FIG. 9).

The formation of a file-like coarse surface 6 on a large substrate 7 can be easily accomplished by the use of any conventional device used for the production of sandpapers. The separation of small sectioned cutters of file-like coarse surfaces from the large substrate can also be easily accomplished by the use of any conventional cutting device. The cutter 1 of the present invention can be produced not only in a rectangular shape as illustrated in FIG. 8, FIG. 10, and FIG. 11 but also in the shape of a strip, a triangle, a circle, or other figures.

The undercoating adhesive agent 8 is desired to have viscosity of 300 and 1,500 cps at the time of its application. If the viscosity is very low, the undercoating adhesive agent 8 applied on the surface of the substrate 7 is liable to flow down the surface and cannot be deposited in a required thickness on the surface. Thus, it fails to fulfil the function of improving the adhesiveness of the substrate to the irregular granules 10. If the viscosity is very high, the undercoating adhesive agent 8 cannot be easily applied evenly to the surface and tends to give rise to portions permitting easy local separation of irregular granules 10. Optionally, in the production of the cutter 1 illustrated in FIG. 5 and FIG. 6, the irregular granules 10 may be deposited as mixed with the undercoating adhesive agent 8 on the substrate. The application of this mixture renders the aforementioned use of the conventional sandpaper manufacturing device infeasible. It is, therefore, more desirable to effect the deposition of irregular granules on the substrate 7 separately of the application of the undercoating adhesive agent.

The soft adhesive agent 9 is desired to have viscosity in the range of 50 to 250 cps at the time of its application. If the viscosity is very low, the soft adhesive agent 9 cannot be easily applied in a required thickness and fails to keep hold of irregular granules 10 with sufficient fastness. Conversely, if the viscosity is very high, the soft adhesive agent 9 tends to form a thick film covering the upper parts of the irregular granules 10 during the production of the cutter 1 illustrated in FIG. 5 and FIG. 6 and the cutter 1, therefore, is liable to lose sharpness.

Figure 12:
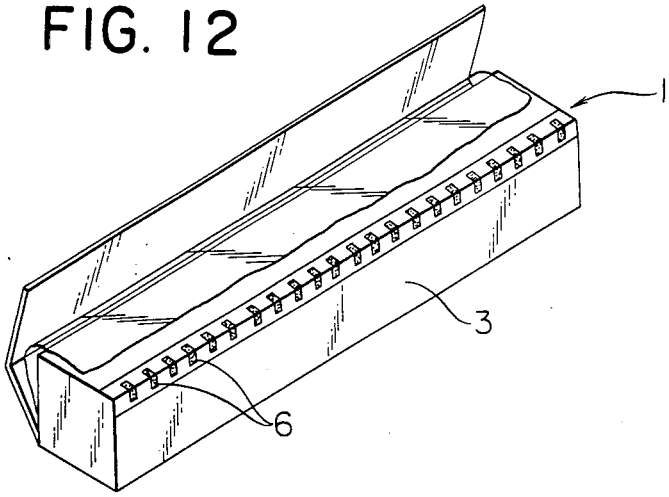
FIG. 12 is a perspective view of a dispensing container 3 provided with a strip of the cutter 1 cut from the substrate 7 of a large size shown in FIG. 6.

It is not always necessary that two cutters 1 of this invention should be attached one each at the opposite end parts of a dispensing container 3 as illustrated in FIG. 1. Instead, only one cutter 1 of the invention may be fastened to either end part of the dispensing container to be selected by the user's habitual use of either hand. Otherwise, one cutter 1 in the form of a strip may be fastened to the dispensing container along the entire length of a ridge 5. Where the cutter 1 is to be used in the form of a strip, one strip may be cut from the large substrate 7 illustrated in FIG. 9 to produce a cutter 1 having file-like coarse surfaces 6 formed thereon intermittently and this cutter 1 may be attached to the dispensing container 3 is illustrated in FIG. 12.

The attachement of the cutter 1 of this invention to the dispensing container 3 can be effected by the use of a conventional labeling machine, on the condition that the cutter 1 is provided on the rear side thereof with a pressure-sensitive adhesive 11 and a release paper 12.

When the dispensing container 3 to which the cutter 1 of the present invention is attached is intended to hold a roll of sheet material 2, it is desired to have a length greater so much than the width of the sheet material 2 as to accommodate therein the sheet material 2 with a margin W of not less than 5 mm in the direction of width of the sheet material 2. If the length of the dispensing container 3 and the width of the sheet material 2 are substantially equal, the cutter 1 of the present invention must be disposed as closely to the lateral end of the dispensing container 3 as possible for the purpose of enabling the lateral end of the sheet material 2, the most desirable position for starting the cutting of the sheet material 2, to be easily applied on the file-like coarse surface 6. Practically, it is difficult for the cutter 1 to be mechanically attached with accuracy as closely to the lateral end of the dispensing container 3 as possible. When the sheet material 2 is held in the dispensing container 3 with the margin W left in the direction of width, since the lateral end of the sheet material 2 falls at a position inwardly by the distance of the margin W from the corresponding lateral end of the dispensing container 3, the lateral end of the sheet material 2 can be easily applied to the file-like coarse surface 6 even if the cutter 1 is positioned more or less inwardly from the lateral end of the dispensing container 3 as illustrated in FIG. 13.

Figure 13:
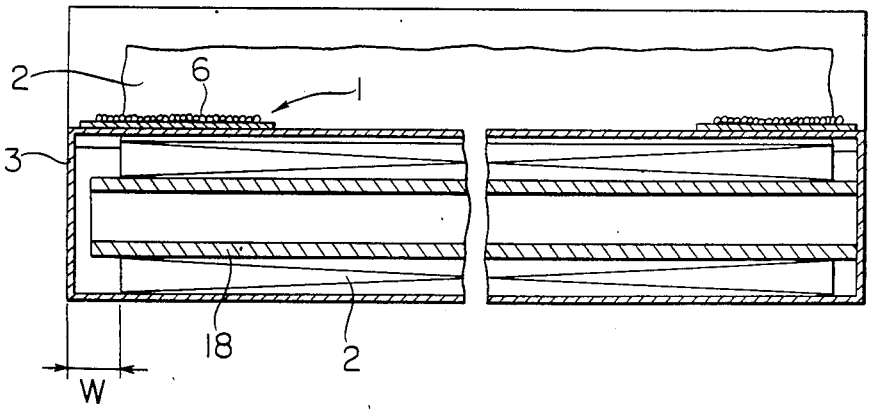
FIG. 13 is a perspective view of a dispensing container 3 provided with the cutter 1 and accommodating therein a rolled sheet material 2 with ample allowance reserved therein.

When the roll of sheet material 2 is accommodated with the margin W in the dispensing container 3 as shown in FIG. 13, the core tube 18 on which the roll of sheet material 2 is wound has a length substantially equal to the length of the dispensing container 3. In this arrangement, any unwanted play of the roll of sheet material 2 inside the dispensing container 3 can be eliminated. Moreover, since the lateral ends of the core tube 18 support the lateral wall parts of the dispensing container 3 from inside, they prevent the lateral wall parts from being crushed from the outside.

Figure 14:
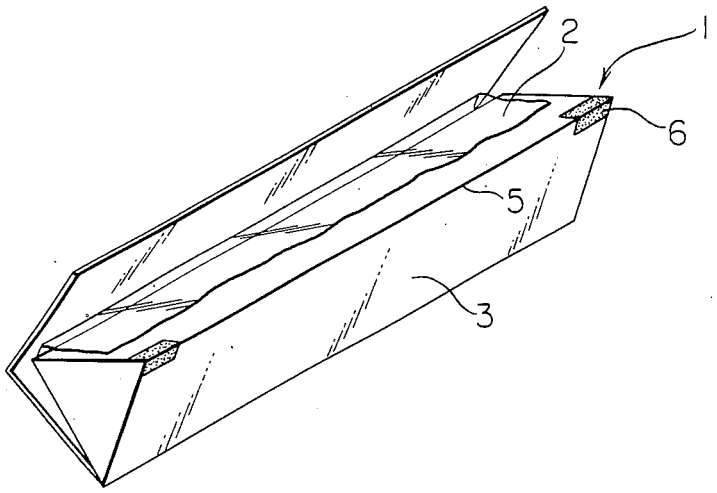
FIG. 14 is a perspective view of a dispensing container 3 of a triangular cross section provided with the cutter 1.

When the dispensing container 3 to which the cutter 1 of the present invention is attached is formed in the shape of a triangular prism as illustrated in FIG. 14 and the cutter 1 is attached to the dispensing container 3 in such a manner as to cover the ridge 5 at a position falling in the direction in which the sheet material 2 is drawn out of the container, the file-like coarse surface 6 can be formed in an acute angle. As a result, the sheet material 2 can be pressed more easily against the file-like coarse surface 6 and the cutter 1 itself gains in sharpness. Even when the cutter 1 is folded with such an acute angle is described above, the possibility of the applied layer of the adhesive agent sustaining a crack and inducing unwanted separation of irregular granules 10 can be eliminated.

Figure 15:
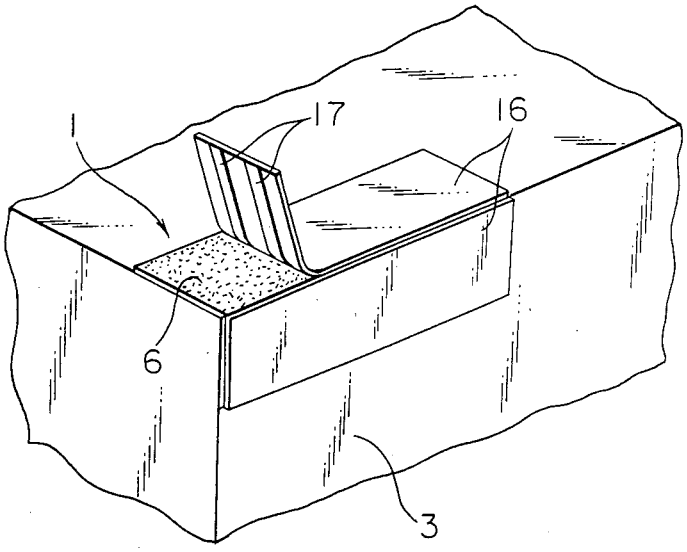
FIG. 15 is a partially magnified perspective view of a dispensing container 3 provided with the cutter 1 having a file-like coarse surface 6 thereof covered with a protective sheet 16.

The file-like coarse surface 6 of the cutter 1 attached to the dispensing container 3 may be covered with a protective sheet 16 as illustrated in FIG. 15. When a large number of dispensing containers 3 each provided with the cutter 1 of the construction described above are transported in a mass, it is possible to eliminate the possibility that the file-like coarse surfaces 6 of the adjoining dispensing containers 3 will rub against each other to impair the sharpness of the cutters.

The protective sheet 16 can be made of the same material as the aforementioned substrate 7. The deposition of this protective sheet 16 on the file-like coarse surface 6 can be accomplished by applying on one side of the protective sheet 16 a pressure-sensitive adhesive 17 having a relatively weak adhesive force such that the protective sheet 16 will be easily peeled off the file-like coarse surface 6. If part of the pressure-sensitive adhesive 17 remains on the file-like coarse surface 6 when the protective sheet 16 is peeled off, the sharpness of the cutter 1 is impaired. For the purpose of minimizing the amount of the pressure-sensitive adhesive 17 suffered to remain on the file-like coarse surface 6 and enabling the cutter 1 to retain its sharpness as required, the application of the pressure-sensitive adhesive 17 on the protective sheet 16 is desired to be made in the form of a line as illustrated in FIG. 15 or in the form of dots (not illustrated in the diagram).

Now, the present invention will be described specifically below with reference to a working example and a comparative experiment. It should be noted, however, that this invention is not limited to the working example.

EXAMPLE

A cutter of this invention was manufactured by using a substrate, an undercoating adhesive agent (hard adhesive agent), a soft adhesive agent, irregular granules, a pressure-sensitive adhesive, and a release paper described below.

| | | |
|---|---|---|
| (1) | Substrate - A coated paper weighing 64 g/m$^2$ and having flexibility of 16 cm/15 mm lengthwise and 12 cm/15 mm widthwise as measured by the method of JIS P-8143. | |
| (2) | Composition of undercoating adhesive agent - | |
| | Resol type phenol resin (solids content 73%) | 100 parts by weight |
| | Polyhydric alcohol polyglycidyl ether (solids content 100%) | 20 parts by weight |
| (3) | Composition of soft adhesive agent | |
| | Modified styrene-butadiene copolymer latex (solids content 49%) | 100 parts by weight |
| | Polyvinyl alcohol (10% solution) | 5 parts by weight |
| | Melamine resin | 5 parts by weight |
| | Melamine resin catalyst | 0.3 parts by weight |
| (4) | Amorphous granules - Abrasive granules of 120 mesh. | |
| (5) | Pressure-sensitive adhesive - Acrylic ester type pressure-sensitive adhesive. | |
| (6) | Release paper - Glassine having the surface thereof treated with silicone. | |

On the rear side of the substrate, the pressure-sensitive adhesive was applied and covered with the release paper. On the front side of the substrate, the undercoating adhesive agent was applied with a rubber roll at a rate of about 100 g/m$^2$. On the applied layer of the undercoating adhesive agent, the irregular granules were sprinkled at a rate of about 500 g/m$^2$. After the applied layer of the undercoating adhesive agent was cured by drying, loose irregular granules were brushed off the surface of the substrate. On the firmly planted irregular granules, the soft adhesive agent was applied by spraying at a rate of about 200 g/m$^2$. The applied layer of the soft adhesive agent was thoroughly dried.

Figure 16:
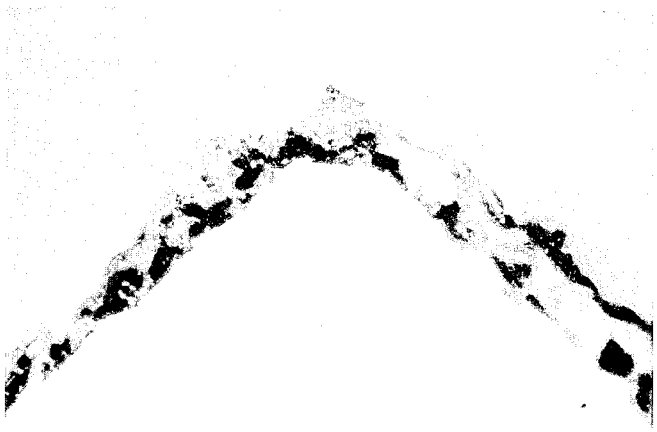
FIG. 16 is a magnified photograph illustrating in side elevation a typical cutter of this invention in a state attached to a corner of an eraser.
Figure 17:
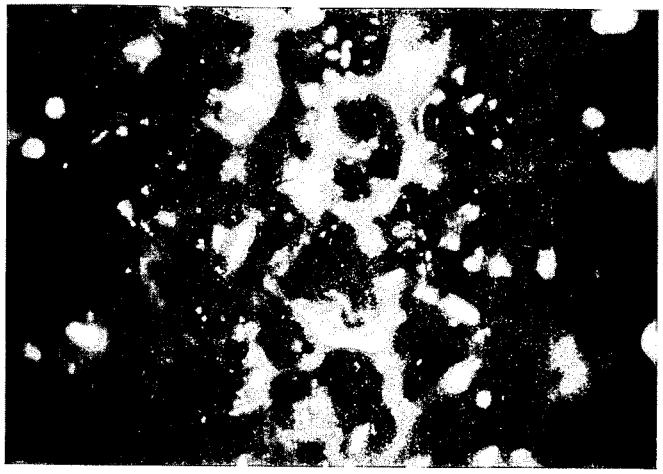
FIG. 17 is a magnified photograph illustrating in front elevation the corner of the cutter of FIG. 16.

The cutter obtained as described above was stripped of the release paper, folded at an angle of about 90°, and attached in such a manner as to cover one corner of an eraser. The file-like coarse surface of the cutter was examined for possible detection of a crack, only in vain. A magnified photograph of a side view of the cutter attached to the corner of the eraser and a magnified photograph of the front view of the corner are shown respectively in FIG. 16 and FIG. 17.

The undercoating adhesive agent used in this working example showed viscosity of 700 cps at the time of application and Vickers hardness of 20 Hv after drying. The soft adhesive agent showed viscosity of 150 cps at the time of application and an elongation of 350% after drying as measured by the method of ASTM D-882.

COMPARATIVE EXPERIMENT

A comparative cutter was manufactured by following the procedure of Working Example, except that the soft adhesive agent was changed to the same hard adhesive agent as used in the undercoating adhesive agent and applied with a rubber roll and the irregular granules were deposited fast with two layers of hard adhesive agent.

Figure 18:
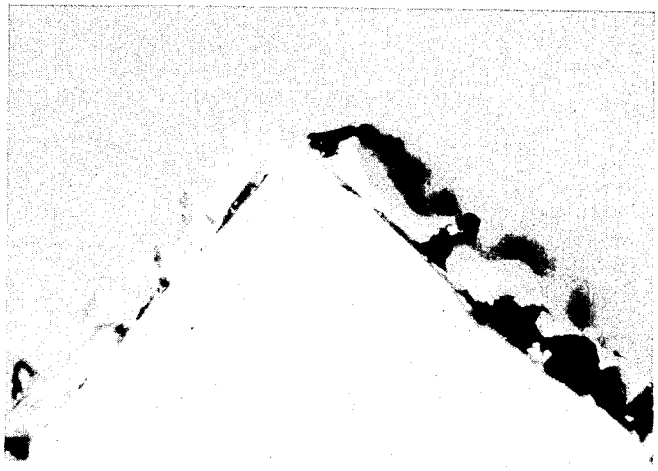
FIG. 18 is a magnified photograph illustrating in side elevation a conventional cutter in a state attached to a corner of an eraser.
Figure 19:
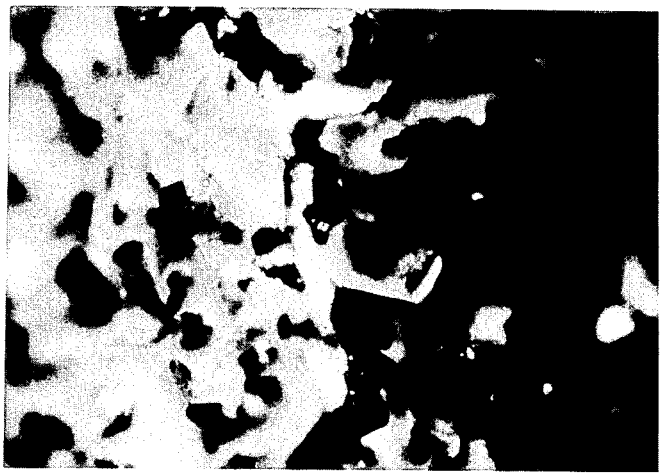
FIG. 19 is a magnified photograph illustrating in front elevation the corner of the cutter of FIG. 18.

The comparative cutter obtained as described above was attached to the corner of an eraser in the same manner as in Working Example. When the file-like coarse surface of this cutter was examined for possible detection of a crack, a large crack was observed. A magnified photograph of the side view of the comparative cutter attached to the corner of the eraser and a magnified photograph of the front view of the corner are shown respectively in FIG. 18 and FIG. 19.

What is claimed is:

1. A cutter for dispensing container, characterized by having a file-like coarse surface formed on the surface of a foldable substrate by fast adhesion of irregular granules to the surface of said substrate with a soft adhesive agent covering said irregular granules, said soft adhesive agent having an elongation of 130 to 700%, as measured in accordance with ASTM D-882.

2. A cutter according to claim 1, wherein said irregular granules are attached fast to said substrate with an undercoating adhesive agent and are covered with a layer of said soft adhesive agent.

3. A cutter according to claim 2, wherein said undercoating adhesive agent is a hard adhesive agent.

4. A cutter according to claim 3, wherein said undercoating adhesive agent has a Vickers hardness of 5 to 40 Hv after solidification.

5. A cutter according to claim 3, wherein said undercoating adhesive agent and said covering of soft adhesive agent have thicknesses such that the ratio of the thickness of the latter to that of the former is in the range of 1:1 to 20:1.

6. A cutter according to claim 3, wherein said hard adhesive agent is mainly consisting of a member selected from the group consisting of resol type phenolic resin, epoxy resin, melamine resin, rigid polyurethane, and urea resin.

7. A cutter according to claim 1, wherein said soft adhesive agent is selected from the group consisting of styrene-butadiene rubber, nitrile-butadiene rubbers, polyvinyl chloride type rubbers, polyvinyl acetate type rubbers, natural rubber and soft polyurethane.

8. A cutter according to claim 1, wherein said irregular granules are selected from the group consisting of abrasive granules, metal granules, and mixtures thereof and have diameters in the range of 30 to 500$\mu$.

9. A cutter according to claim 1, wherein said irregular granules are metal granules and the entire surface of said substrate forms a file-like coarse surface.

10. A cutter according to claim 1, wherein said irregular granules are abrasive granules and a file-like coarse surface formed on the surface of said substrate is enclosed with an edge part bare of the abrasive granules.

11. A cutter according to claim 1, wherein said irregular granules are buried in said layer of adhesive agent to a depth of ½ to 9/10 of the height of said granules and are protruded from the surface of said layer of adhesive agent by at least 30$\mu$.

12. A cutter according to claim 1, wherein the cutter is provided on the rear side thereof with a layer of pressure-sensitive adhesive covered with a release paper.

13. A dispensing container provided with a cutter, said cutter having a file-like coarse surface formed on the surface of a foldable substrate by fast adhesion of irregular granules to the surface of said substrate with a soft adhesive agent covering said irregular granules and having an elongation of 130 to 700%, as measured in accordance with ASTM D-882, and said dispensing container accommodating a sheet material extractively therein and having said cutter attached thereto in a folded state in such a manner as to cover a ridge of said dispensing container positioned in a direction in which said sheet material is drawn out of said container.

14. A dispensing container according to claim 13, wherein said cutter is disposed only at a one lateral end of said dispensing container.

15. A dispensing container according to claim 13, which accommodates therein a roll of sheet material whose width is smaller than the length of said dispensing container.

16. A dispensing container according to claim 13, which is formed in the shape of a triangular prism.

* * * * *